US009032981B2

(12) United States Patent
Rhines

(10) Patent No.: US 9,032,981 B2
(45) Date of Patent: May 19, 2015

(54) PAINTING IMPLEMENT CLEANING AND SUPPORT APPARATUS

(71) Applicant: Michael Rhines, Orange, TX (US)

(72) Inventor: Michael Rhines, Orange, TX (US)

( * ) Notice: Subject to any disclaimer, the term of this patent is extended or adjusted under 35 U.S.C. 154(b) by 192 days.

(21) Appl. No.: 13/815,969

(22) Filed: Mar. 19, 2013

(65) Prior Publication Data

US 2013/0206191 A1 Aug. 15, 2013

Related U.S. Application Data

(63) Continuation-in-part of application No. 12/799,357, filed on Apr. 23, 2010, now Pat. No. 8,439,054.

(51) Int. Cl.

| | |
|---|---|
| ***A46B 17/06*** | (2006.01) |
| ***B05C 17/005*** | (2006.01) |
| ***B08B 3/02*** | (2006.01) |
| ***B44D 3/00*** | (2006.01) |

(52) U.S. Cl.

CPC ..... *B05C 17/005* (2013.01); *A46B 17/06* (2013.01); *B08B 3/02* (2013.01); *B44D 3/006* (2013.01); *A46B 2200/202* (2013.01)

(58) Field of Classification Search

CPC ..... B44D 3/006; B08B 3/02; A46B 17/06; A46B 2200/202; B05C 17/005

USPC ..... 15/104.92, 142, 201, 230.11, 15/248.1–248.2, 257.01; 134/38, 182, 134/198, 201, 900

See application file for complete search history.

(56) References Cited

U.S. PATENT DOCUMENTS

| | | | | | |
|---|---|---|---|---|---|
| 2,938,368 | A | * | 5/1960 | Bixel | 68/205 R |
| 2,965,111 | A | * | 12/1960 | Feigelman | 134/135 |
| 3,037,516 | A | * | 6/1962 | Leach | 134/138 |
| 3,075,534 | A | * | 1/1963 | Habostad | 134/138 |
| 3,087,190 | A | * | 4/1963 | Werner | 34/58 |
| 3,133,548 | A | * | 5/1964 | Carr | 134/138 |
| 3,139,891 | A | * | 7/1964 | Faustman | 134/138 |
| 3,422,828 | A | * | 1/1969 | Dommer | 134/138 |
| 3,472,251 | A | * | 10/1969 | Parker, Jr. | 134/138 |
| 3,577,280 | A | * | 5/1971 | George | 134/138 |
| 3,696,457 | A | * | 10/1972 | Hand | 15/4 |
| 3,755,840 | A | * | 9/1973 | Barger | 134/138 |
| 3,818,529 | A | * | 6/1974 | Leggett | 134/138 |
| 3,837,035 | A | * | 9/1974 | Habostad | 134/138 |
| 3,886,960 | A | * | 6/1975 | Krueger | 134/138 |
| 3,897,797 | A | * | 8/1975 | Wright et al. | 134/113 |
| 4,061,153 | A | * | 12/1977 | Doherty | 134/138 |
| 4,108,189 | A | * | 8/1978 | Claiborne et al. | 134/138 |
| 4,130,124 | A | * | 12/1978 | Sherwin | 134/138 |
| 4,142,540 | A | * | 3/1979 | Vegiard | 134/138 |
| 4,448,209 | A | * | 5/1984 | Lindsay | 134/141 |
| 4,549,562 | A | * | 10/1985 | Ossi | 134/138 |

(Continued)

*Primary Examiner* — Arlen Soderquist
(74) *Attorney, Agent, or Firm* — Kenneth D. Baugh

(57) ABSTRACT

A painting implement cleaning and storage apparatus 10 is provided. The apparatus facilitates the cleaning and storage of painting implements such as a roller 12, a brush 14 and a roller pan 16. The apparatus includes a base 18 and a bracket 32 coupled to the base. The roller 12 is supported on the bracket 32 in an upwardly extending diagonal position between shields 45 and 54 for containing paint spreads from the roller. The brush 14 is supported on bracket 32 in a upwardly projecting position. A roller pan 16 is coupable to shield 45 and supported thereon in a descending position. Once the painting implements 12, 14 and 16 are supported on the apparatus 10, cleaning can be accomplished by the application of a stream of water thereto after which the implements can be left until they are needed.

23 Claims, 9 Drawing Sheets

(56) References Cited

U.S. PATENT DOCUMENTS

| | | | | | |
|---|---|---|---|---|---|
| 4,569,099 | A | * | 2/1986 | Harding | 15/248.2 |
| 4,593,428 | A | * | 6/1986 | Calvert | 134/138 |
| 4,641,673 | A | * | 2/1987 | Conley et al. | 134/138 |
| 4,667,363 | A | * | 5/1987 | Calvert | 15/248.2 |
| 4,672,987 | A | * | 6/1987 | Brandt | 134/138 |
| 4,711,258 | A | * | 12/1987 | Rossborough et al. | 134/138 |
| 4,735,221 | A | * | 4/1988 | Vegiard | 134/138 |
| 4,765,353 | A | * | 8/1988 | Rhoades | 134/138 |
| 4,809,722 | A | * | 3/1989 | Pennise | 134/138 |
| 4,832,066 | A | * | 5/1989 | Shipman | 134/138 |
| 5,005,598 | A | * | 4/1991 | Hodgdon | 134/138 |
| 5,050,626 | A | * | 9/1991 | Brockage et al. | 134/138 |
| 5,095,928 | A | * | 3/1992 | Phipps | 134/138 |
| 5,238,012 | A | * | 8/1993 | Coronato | 134/140 |
| 5,363,869 | A | * | 11/1994 | McDowell | 134/138 |
| 5,402,808 | A | * | 4/1995 | Wallis et al. | 134/104.2 |
| 5,413,133 | A | * | 5/1995 | Russell | 134/138 |
| 5,487,399 | A | * | 1/1996 | Hannah | 134/138 |
| 5,505,220 | A | * | 4/1996 | Gorecki | 134/138 |
| 5,614,021 | A | * | 3/1997 | Catlin | 134/138 |
| 5,626,158 | A | * | 5/1997 | Gratopp | 134/138 |
| 5,641,007 | A | * | 6/1997 | Falk | 141/106 |
| 5,651,381 | A | * | 7/1997 | Balouchian | 134/138 |
| 5,816,275 | A | * | 10/1998 | Mullen | 134/141 |
| 5,839,459 | A | * | 11/1998 | Bisby | 134/138 |
| 5,899,429 | A | * | 5/1999 | McCloud | 248/441.1 |
| 6,019,111 | A | * | 2/2000 | Gillies | 134/138 |
| 6,408,862 | B1 | * | 6/2002 | van Rooyen | 134/138 |
| 6,450,185 | B1 | * | 9/2002 | Sallinen | 134/138 |
| 8,439,054 | B2 | * | 5/2013 | Rhines | 134/198 |
| 2002/0050280 | A1 | * | 5/2002 | Brackett et al. | 134/6 |
| 2004/0003835 | A1 | * | 1/2004 | Higgins | 134/138 |
| 2005/0224104 | A1 | * | 10/2005 | Bleyaert | 134/151 |
| 2006/0000497 | A1 | * | 1/2006 | Searle et al. | 134/137 |
| 2006/0048804 | A1 | * | 3/2006 | Walter | 134/198 |
| 2006/0060221 | A1 | * | 3/2006 | Beaver | 134/33 |
| 2006/0243309 | A1 | * | 11/2006 | Prescott et al. | 134/33 |
| 2006/0272683 | A1 | * | 12/2006 | Wallace | 134/138 |
| 2007/0089765 | A1 | * | 4/2007 | Clark | 134/103.2 |
| 2007/0221260 | A1 | * | 9/2007 | Watters et al. | 134/149 |
| 2008/0072932 | A1 | * | 3/2008 | Nicholas | 134/34 |
| 2008/0078429 | A1 | * | 4/2008 | Hoffmann | 134/178 |
| 2008/0083434 | A1 | * | 4/2008 | Lavender et al. | 134/198 |
| 2008/0105284 | A1 | * | 5/2008 | Bates | 134/198 |
| 2009/0000646 | A1 | * | 1/2009 | Durant et al. | 134/22.11 |
| 2009/0217952 | A1 | * | 9/2009 | Moar | 134/38 |
| 2013/0152980 | A1 | * | 6/2013 | Hues | 134/36 |

* cited by examiner

PAINTING IMPLEMENT CLEANING AND SUPPORT APPARATUS

TECHNICAL FIELD

This application is a continuation in part of my U.S. patent application Ser. No. 12/799,357 filed on Apr. 23, 2010 now U.S. Pat. No. 8,439,054.

This invention relates to painting implements and more particularly to an apparatus to be used in cleaning painting implements such as paint brushes, paint rollers and roller pans. It has long since been recognized that painting by professionals as well as non-professionals has been and will continue to be a very necessary activity. Because of the nature of the activity it is understood that the painting operation is not complete until the somewhat tedious process of cleaning the painting implements, that is the brush, roller and roller pan is done. It is also understood that proper cleaning of the implements extends their useful life and the need to replace them after each painting.

However, several problems arise regarding the cleaning process. First of all the cleaning process can be somewhat unpleasant because one of the more effective methods of cleaning the implements is of course by hand. This can take a significant amount of time, and can be extremely messy and result in washing spreads of paint all over the painter's body and clothing. Additionally once the cleaning process is completed the process of drying the implements and then storing them for future use can be problemsome. Accordingly it is desirable to provide an apparatus that can facilitate the cleaning process so that the messy washing spreads of paint are minimized while also allowing the implements to readily dry and be stored for future use.

BACKGROUND OF THE ART

Attempts have been made to provide painting tool cleaning apparatuses that minimize the messiness of the clean up process. One such apparatus is disclosed in U.S. Pat. No. 4,569,099. The apparatus is a paint roller washing shield. The apparatus includes a shield and a semi-cylindrical handle extending from the shield for receiving the handle of the roller. The shield receives the paint roller with a portion of the roller extending outwardly from the shield so it can be exposed to a stream of water from a water hose to facilitate cleaning while minimizing unwanted messy paint spreads.

Another arrangement is disclosed in U.S. Pat. No. 5,406,967. This invention discloses an apparatus for cleaning a paint brush. In this cleaning apparatus a paint brush is located through an exit region of an elongated cavity of a nozzle-like housing. A cleaning fluid such as water enters the housing from an entry region at the water end of the cavity.
This arrangement permits easy and gentle cleaning of paint from the bristles of the brush upon application of water.

These arrangements are suitable for the purposes intended. That is, to provide a cleaning apparatus for a paint roller and paint brush, respectively. However there is a need for an apparatus that will facilitate the cleaning of a paint roller, paint brush and paint roller pan all in a single apparatus. Additionally there is a need for this same apparatus to facilitate the drying of the painting implements and then storage for later use.

DISCLOSURE OF THE INVENTION

A painting implement cleaning and storage apparatus is provided. The painting implement cleaning and storage apparatus of this invention facilitates the cleaning and storage of painting implements such as rollers, brushes and roller pans. The apparatus of this invention is provided with a base support member. A rectangularly shaped support member is coupled to upper portions of the base support member A first member is coupled to first portions of the rectangularly shaped support member so that a roller can be supported thereon in an upwardly extending diagonal position.

A pair of spaced horizontally extending shields, for containing paint spreads from the roller in a predetermined confined area, are coupled to second and third portions of the rectangularly shaped support member adjacent the roller. One of the pair of shields is provided with a pair of spaced apertures formed therein which cooperates with portions of the paint roller pan to allow the paint roller pan to be supported on the shield in a diagonally descending position. The apparatus of this invention is also provided with a second member which is coupled to fourth portions of the rectangularly shaped support member for supporting a paint brush therein in a predetermined position.

Once a painting implement is supported on the apparatus of the invention, cleaning of the desired implement can be accomplished by the application of a stream of water thereto in a predetermined manner.

BRIEF DESCRIPTION OF THE INVENTION

The details of the invention will be described in connection with the accompanying drawing in which.

BEST MODE FOR CARRYING OUT THE INVENTION

Figure 1:
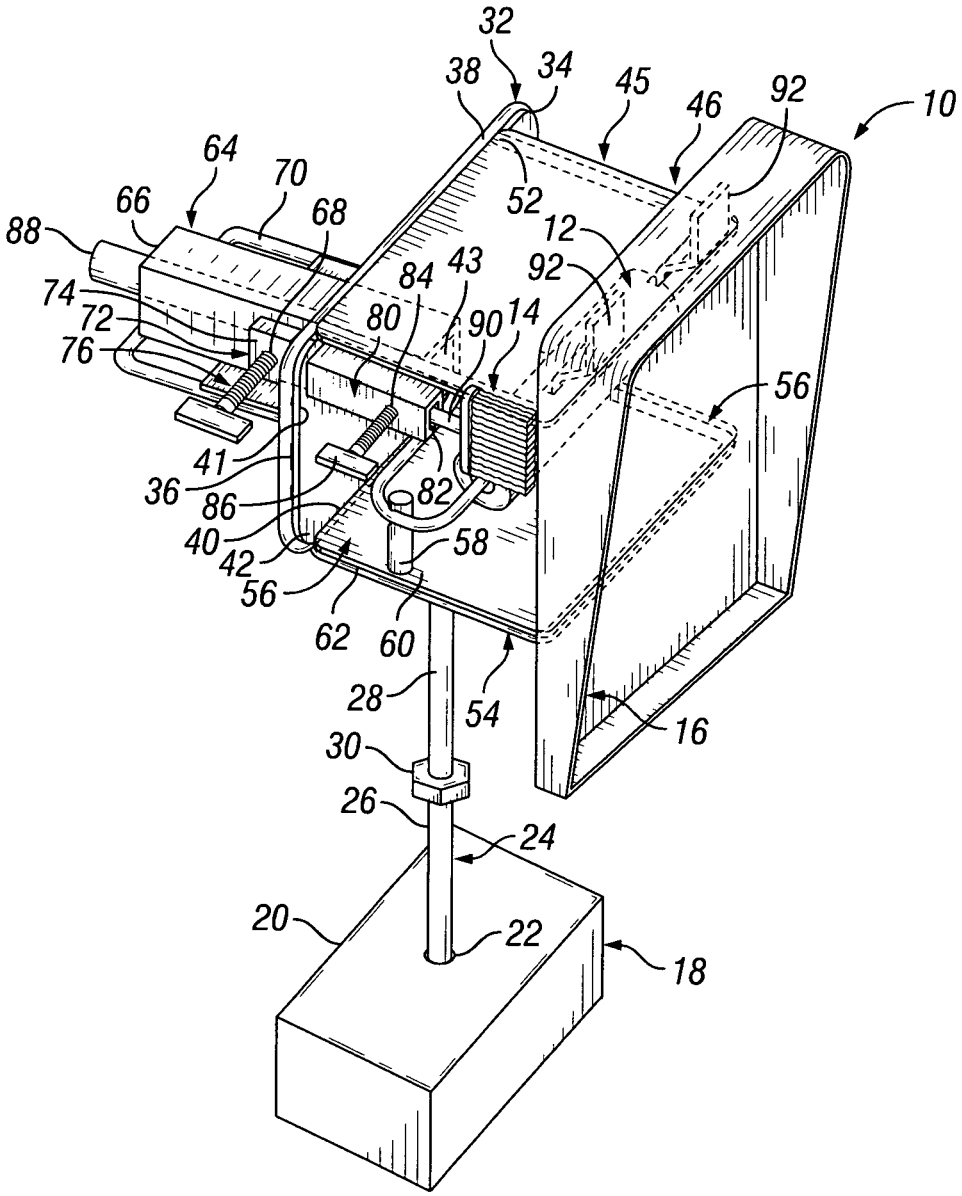
FIG. 1 is a front perspective view illustrating a painting implement cleaning and support apparatus in accordance with the principles of the invention.
Figure 2:
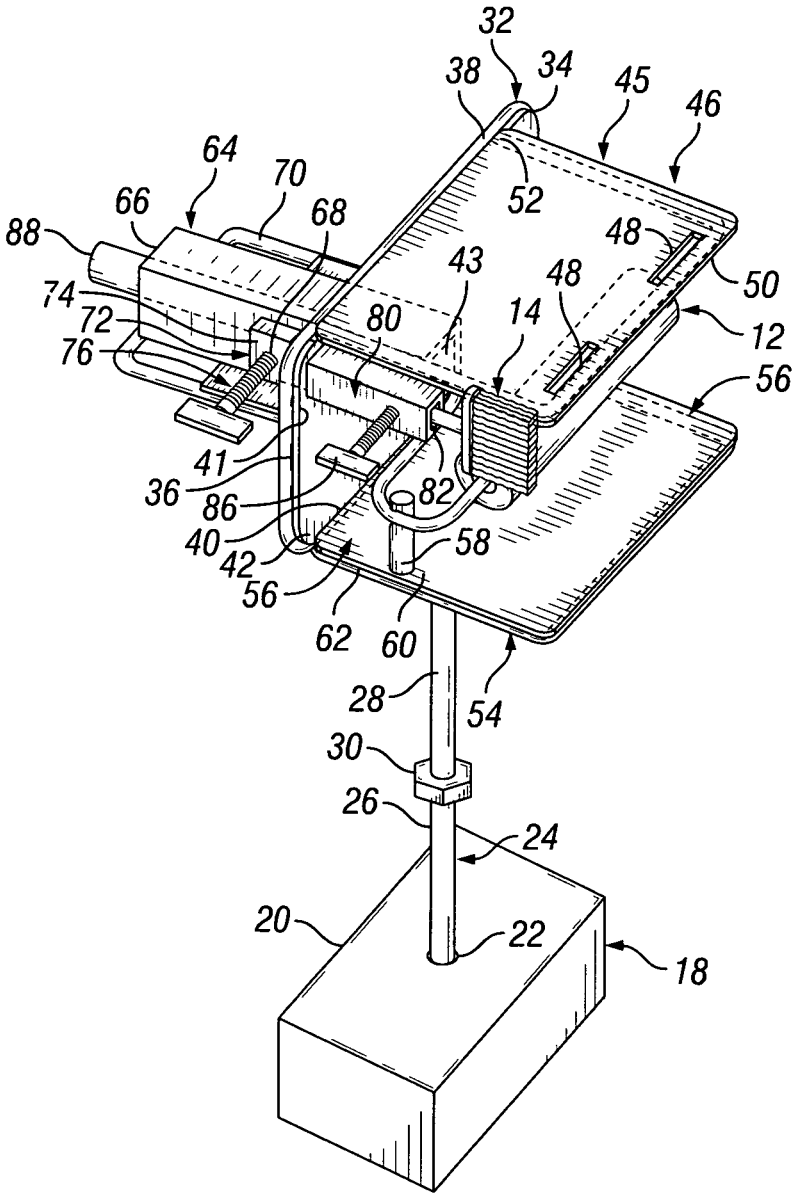
FIG. 2 is another front perspective view illustrating a painting implement and cleaning and support apparatus in accordance with the principles of the invention.
Figure 3:
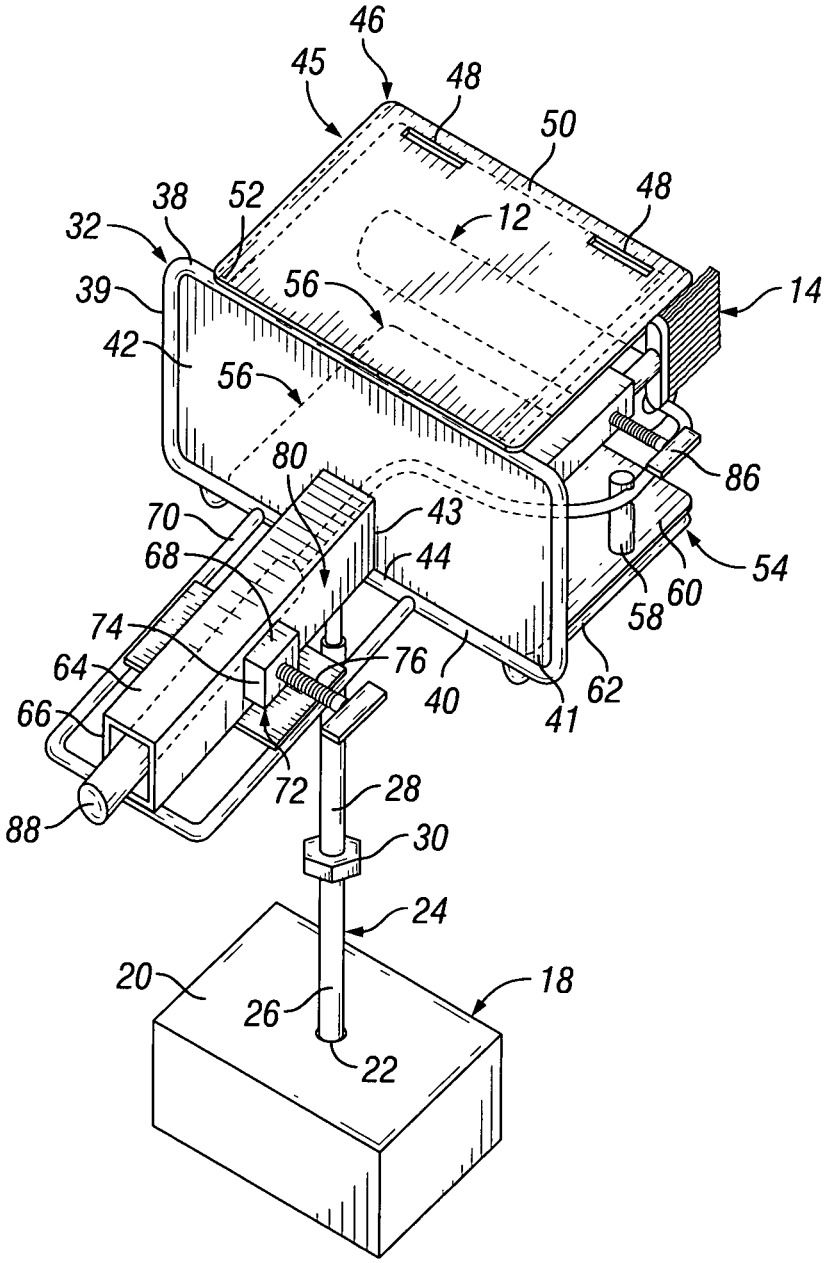
FIG. 3 is back perspective view illustrating a painting implement cleaning and support apparatus in accordance with the principles of the invention.
Figure 4:
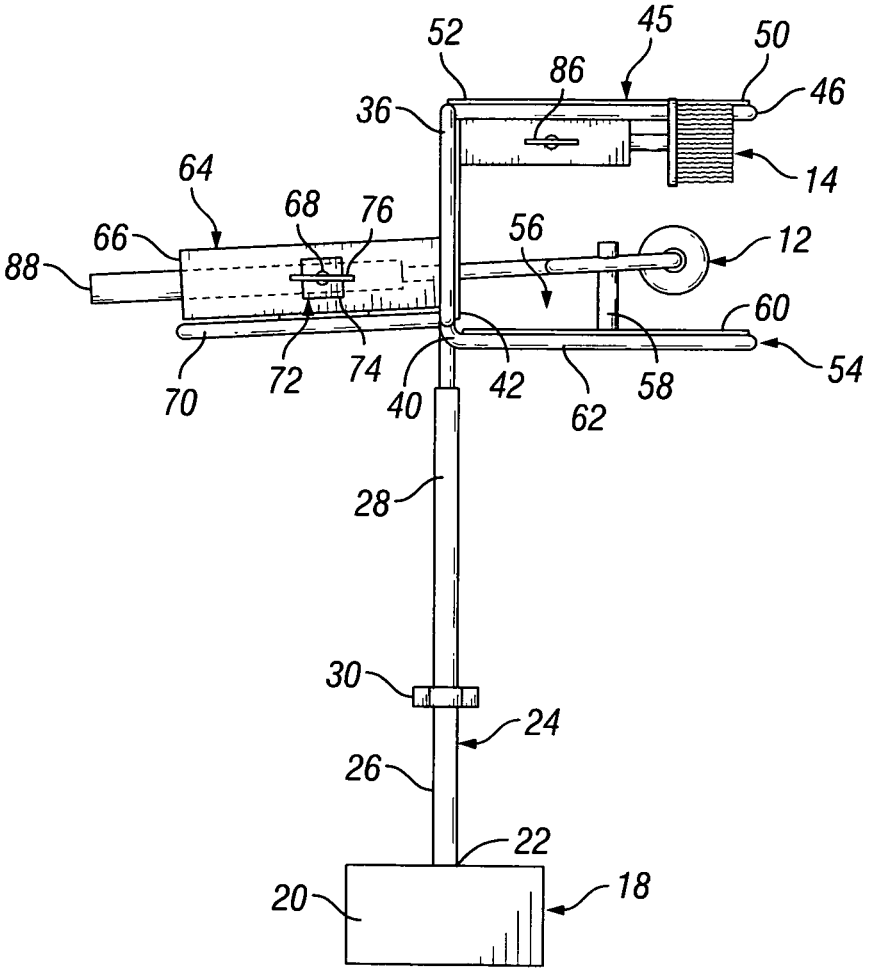
FIG. 4 is a side view of a painting implement cleaning and support apparatus illustrated in FIG. 2 in accordance with the principles of the invention.
Figure 5:
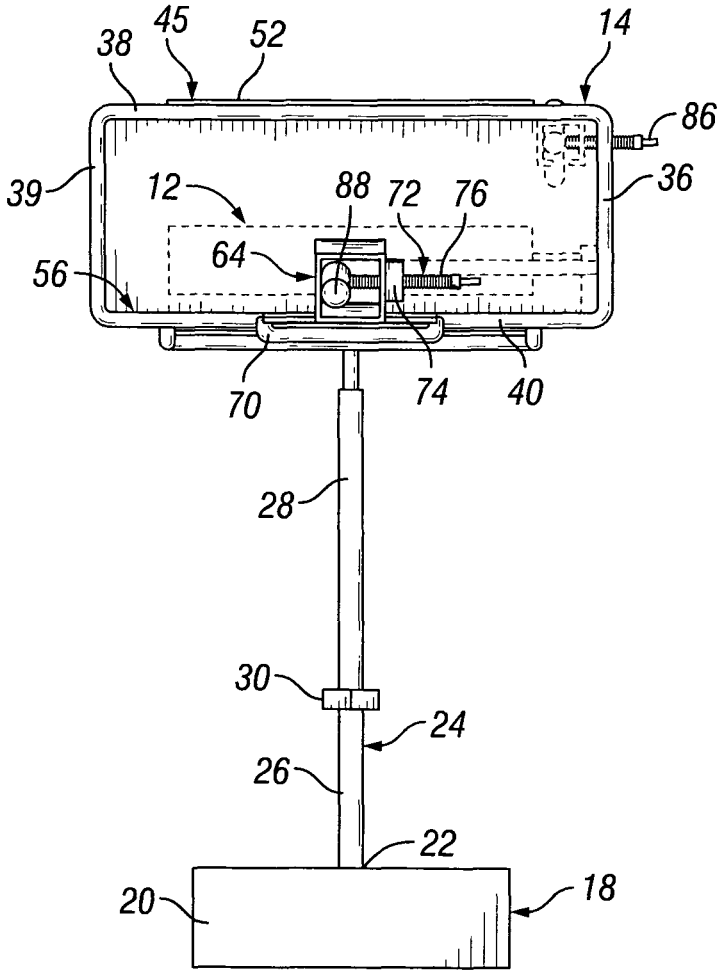
FIG. 5 is a front view of a painting implement cleaning and support apparatus illustrated in FIG. 2 in accordance with the principles of the invention.

Referring to FIGS. 1, 2, 3, 4 and 5 a painting implement cleaning and support apparatus, generally designated by the numeral, 10 is provided. The apparatus 10 is provided for cleaning painting implements such as, for example, a paint roller, generally designated, by the numeral, 12, a paint brush, generally designated by the numeral 14 and a paint roller pan, generally designated, by the numeral 16. (FIG. 1)

The apparatus 10 includes a base support member, generally designated, by the numeral 18. The base support member 18 is provided with a rectangularly shaped base member 20 having an aperture 22 formed in an intermediate portion thereof and a longitudinally shaped extending member, generally designated, by the numeral, 24 vertically mounted in the aperture. The longitudinally extending member includes a first and second elongated member 26 and 28 respectively which are threadeably coupled together by a coupling member 30.

The painting apparatus 10 is also provided with a rectangularly shaped support bracket, generally designated, by the numeral 32. The support bracket 32 includes a pair of spaced vertically extending members 34 and 36, and upper and lower spaced horizontally extending members 38 and 40, respectively. The horizontally extending member 38 is coupled to extend between uppermost portions of the vertically extending members 34 and 36 of the support member 32 and the lower horizontally extending member 40 is coupled to extend between lowermost portions of the vertically extending members 34 and 36 so that an opening 41 is formed between the vertical and horizontally extending members. The support bracket 32 also includes a rectangularly shaped planar shaped cover member 42 having an opening 43 formed therein. The planar shaped cover member 42 is coupled to the vertically extending members 34 and 36 and horizontally extending member 38 and 40 to cover the opening 41 in the support bracket.

The elongated member 28 of the base support member 18 is coupled at an upper portion thereof to an intermediate portion of the lower horizontally extending member 40 of the support bracket 32. This allows the base support member 18 to maintain the apparatus 10 in the desired upright position.

The apparatus 10 is further provided with an upper shield, generally designated, by the numeral, 45. The shield 45 is provided with a horizontally extending planar shaped member, generally designated, by the numeral 46 which includes openings 48 (FIG. 2) formed in an outermost portion 50 thereof.

The shield 45 is adjacently aligned with and coupled to engage the upper horizontally extending member 38 of the support bracket 32 at an innermost portion 52 thereof.

The apparatus 10 is also provided with a lower shield, generally designated, by the numeral 54. The shield 54 is provided with a longitudinally extending planar shaped member, generally designated by the numeral 56 which includes an upstanding vertically extending member 58 formed on a portion 60 thereof. The shield 54 is adjacently aligned with and coupled to engage the lower horizontally extending member 40 of the support bracket 32 at an innermost portion 62 thereof.

The apparatus 10 is also provided with a rectangularly shaped elongated support member, generally designated, by the numeral 64 which is supported on the back of the planar shaped cover member 42. The rectangularly shaped elongated support member 64 has an internal opening 66 formed therein which is aligned adjacent to the opening 43 in the planar shaped cover member 42. The rectangularly shaped elongated support member 64 is additionally provided with an opening 68 which is formed on an outer surface thereof to extend into the internal opening 66. A rectangularly shaped support member 70 is provided to support the elongated member 64 in a diagonally ascending direction on the planar shaped cover member 42. The rectangularly shaped elongated support member 64 also includes an engaging member, generally designated, by the numeral 72. The engaging member 72 includes a support block 74 and an engaging screw 76 threadely supported therein for forward and backward movement in the block. The engaging member 72 is coupled on the rectangularly shaped elongated member 66 so that the engaging screw is aligned in the opening 68 to be moved into and out of the opening 66 when desired.

The apparatus 10 is also provided with a second elongated support member, generally designated, by the numeral, 80 which is coupled to the horizontally extending support member 38 of the support bracket 32 at an outermost portion thereof. The second elongated support member 80 includes an internal elongated opening 82 formed therethrough. The second elongated support member 80 is also provided with an opening 84 which is formed on an outermost surface thereof to extend into the internal opening 82. An engaging member or screw 86 is mounted for movement in the opening 84.

When it is desired to clean the roller 12, the roller is supported in the apparatus by inserting a handle 88 of the roller in the opening 66 in the rectangularly shaped elongated support member 64 so that a portion 89 of the handle is supported around the upstanding member 58. The engaging screw 76 is then moved into the opening 66 to engage the handle 88 so that the handle is held in a stationary position. This positions the roller 12 between the shields 45 and 54 in an upwardly ascending diagonal position so that the shields 45 and 54 respectively are above and under the roller. In this position once a spray of water from, for example, a water hose, is directed against the exposed portion of the roller the roller will spin thereby allowing the paint to be washed out of the roller. While this is going on because of the position of the roller 12 under the shields the user is shielded from the paint and water spray that would normally spread over the user and other areas in proximity of the user.

Similarly when it is desired to clean the brush 14 a handle 90 of the brush is supported in the apparatus 10 by inserting the handle 90 in the opening 82 of the second elongated support member 80 so that the brush is supported upright in the opening. The engaging member 86 is then inserted through the opening 82 of the elongated support member 80 and into engagement with the handle 90. This holds the brush 14 in place in the elongated support member 80. In this instance a spray of water can be directed first at one side of the brush 14 and then at the other side until the brush is thoroughly clean.

Additionally, when it is desired to clean the roller pan 16 the pan is supported on the horizontally extending planar support member 46 of the shield 45 by a pair of legs 92 (shown in dotted) (FIG. 1) forming a part of the pan. Each one of the legs 92 can be inserted in an adjacent one of the openings 48 in the horizontally extending planar shaped member 46 so that the pan 16 is supported in a diagonally descending position so that once a spray of water is applied thereto a thorough cleaning of the pan can be achieved.

Once the cleaning process is completed the paint roller 12, paint brush 14 and roller pan 16 can be left in the designated position thereby allowing them to dry and be stored for future use.

Figure 6:
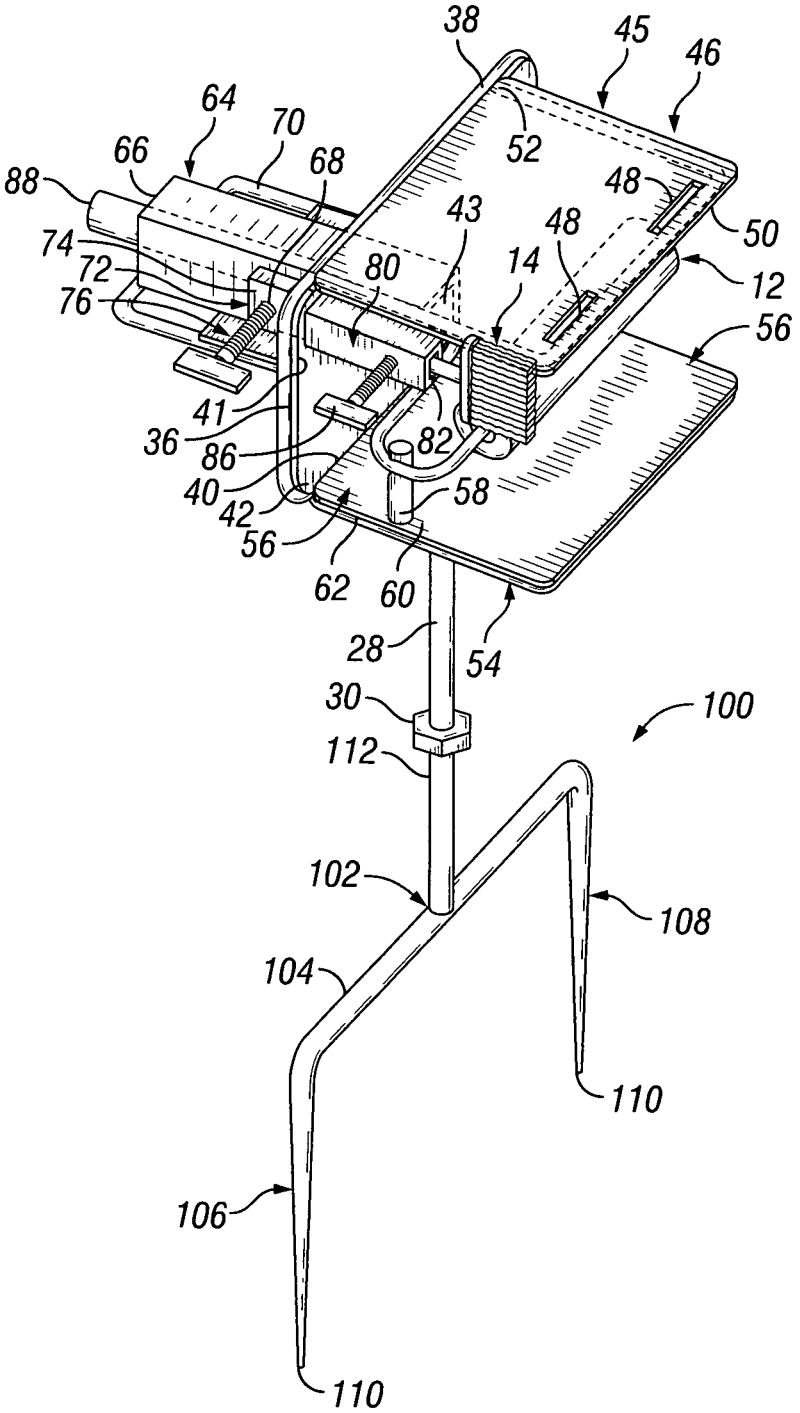
FIG. 6 is a perspective view of a second embodiment of a painting implement cleaning and support apparatus in accordance with the principles of the invention.

Referring to FIG. 6, a second embodiment of the painting implement cleaning and support apparatus generally designated, by the numeral 10 is provided with a different base support member, generally designated by the numeral, 100. The base support member 100 is provided with a u shaped support bracket, generally designated by the numeral 102 having a horizontally extending elongated member 104 and having a pair of spaced vertically extending legs, generally designated, by the numerals 106 and 108. The vertically extending legs 106 and 108 are each formed having a pointed end member 110 at lowermost portions thereof. Uppermost portions of the vertically extending legs 106 and 108 are coupled to an adjacently aligned outermost portion of the horizontally extending member 104.

The base support member 100 is also provided with a longitudinally extending member 112 which is coupled at a lowermost portion thereof to an intermediate portion of the horizontally extending member 104 at an upper portion thereof to the elongated member 28 which is coupled to intermediate portions of the lower horizontally extending member 40 of the support bracket 32.

This base support member allows the cleaning and support apparatus 10 to be supported in the desired position by pushing the pointed end members 110 into coupling engagement with soil (dirt) in a well known manner.

Figure 7:
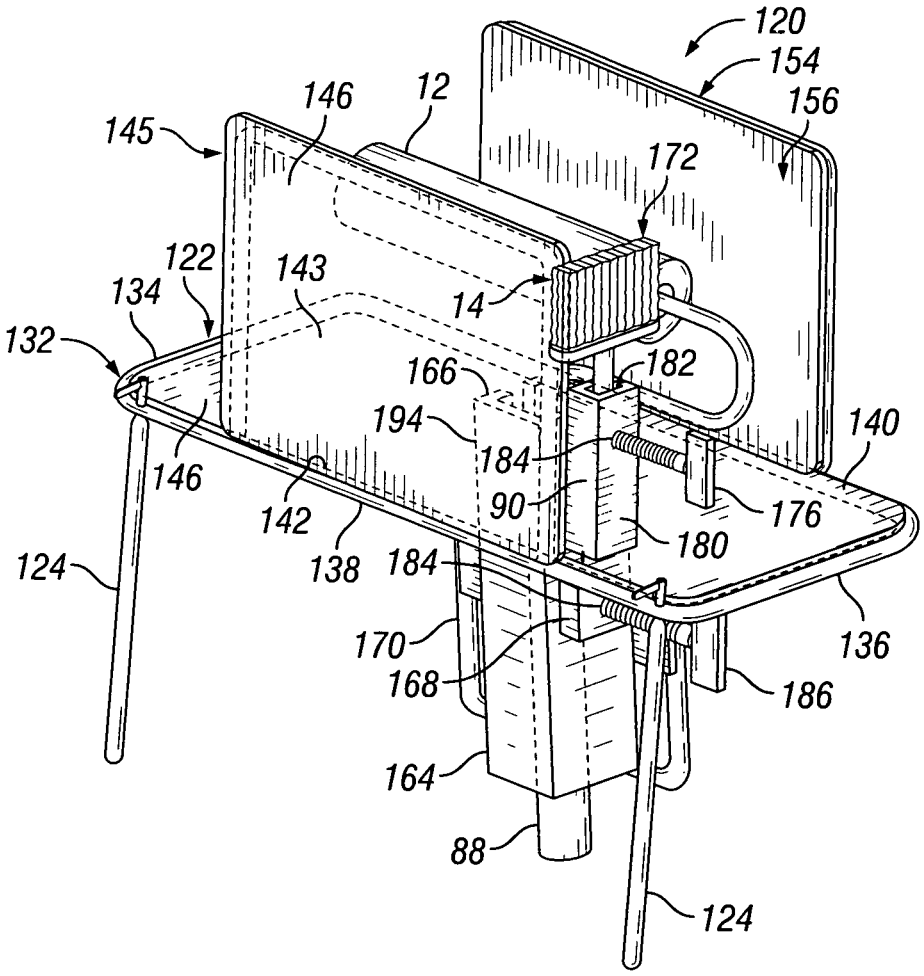
FIG. 7 is a perspective view of a third embodiment of a painting implement cleaning and support apparatus in accordance with the principles of the invention.
Figure 8:
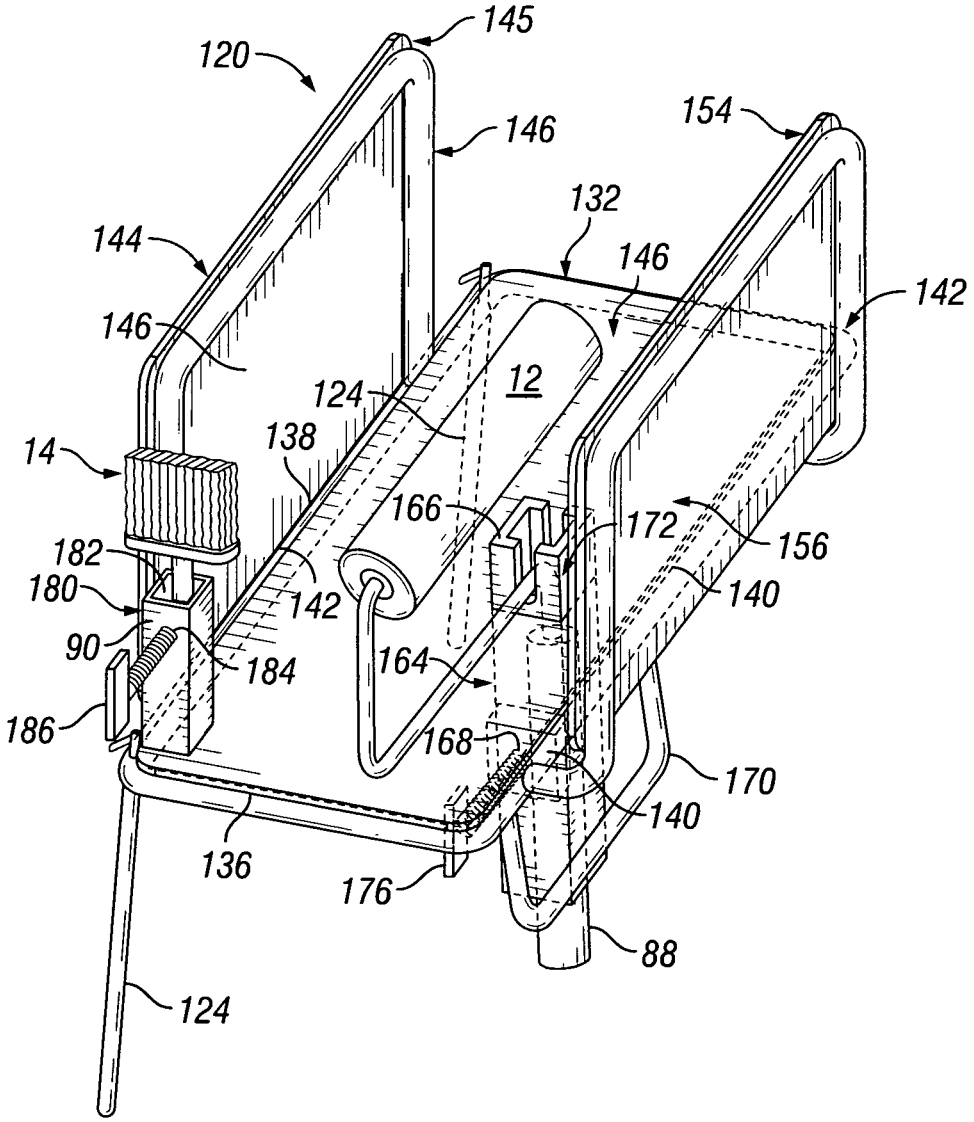
FIG. 8 is another perspective view of a third embodiment of a painting implement cleaning and support apparatus in accordance with the principles of the invention.
Figure 9:
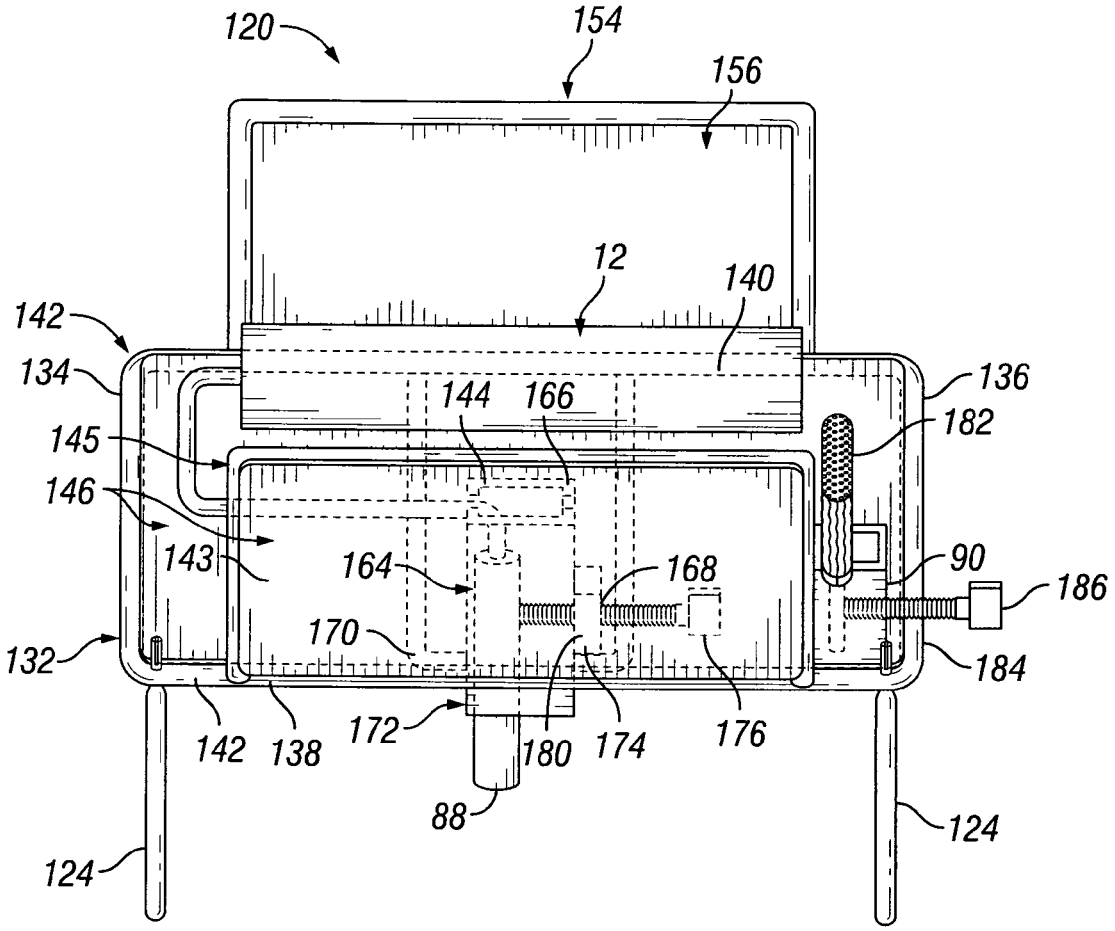
FIG. 9 is another perspective view of a third embodiment of a painting implement cleaning and support apparatus in accordance with the principles of the invention.

Referring to FIGS. 7, 8 and 9 a third embodiment of a painting implement cleaning and support apparatus, generally designated by the numeral, 120 is provided.

The apparatus 120 includes a base support member, generally designated, by the numeral 122. The base support member 122 is provided with a pair of vertically extending elongated legs, generally designated, by the numeral, 124 and a rectangularly shaped support bracket, generally designated, by the numeral 132. The support bracket 132 includes a pair of spaced laterally extending members 134 and 136, and spaced horizontally extending members 138 and 140, respectively. The horizontally extending member 138 is coupled to extend between outermost portions of the laterally extending members 134 and 136 of the support member 132 and the horizontally extending member 140 is coupled to extend between the other outermost portions of the laterally extending members 134 and 136 so that an opening 142 is formed between the vertical and horizontally extending members. The support bracket 132 also includes a rectangularly shaped planar cover member 143 having an opening 144 (FIG. 9) formed therein. The cover member 143 is coupled to the laterally extending members 134 and 136 and horizontally extending member 138 and 140 to cover the opening 142.

Each one of the pair of vertically extending legs 124 is coupled at an upper portion thereof to an outermost portion of the horizontally extending member 138 of the support bracket 132.

The apparatus 120 is further provided with a shield, generally designated, by the numeral, 145. The shield 145 is provided with a vertically extending planar shaped member 146. The shield 145 is aligned with and coupled to extend vertically upwardly from the horizontally extending member 138 of the support bracket 132.

The apparatus 120 is also provided with a shield, generally designated, by the numeral 154. The shield 154 is provided with a vertically extending planar shaped member, generally designated by the numeral 156. The shield 154 is aligned with and coupled to extend vertically upwardly from the horizontally extending member 140 of the support bracket 132.

The apparatus 120 is also provided with a rectangularly shaped elongated support member, generally designated, by the numeral 164 which is supported on the under surface of the planar shaped cover member 143. The rectangularly shaped elongated support member 164 has an internal opening 166 formed therein which is aligned adjacent to the opening 144 in the planar shaped cover member 143. The rectangularly shaped elongated support member 164 is additionally provided with an opening 168 (FIG. 8) which is formed on an outer surface thereof to extend into the internal opening 166. A rectangularly shaped support member 170 is provided to support the rectangularly shaped elongated member 164 in a diagonally ascending direction on the planar shaped cover member 143. The rectangularly shaped elongated support member 164 also includes an engaging member, generally designated, by the numeral 172. The engaging member 172 includes a support block 174 and an engaging screw 176 threadely supported therein for forward and backward movement in the block. The engaging member 172 is coupled on the support block so that the engaging screw is aligned in the opening 168 to be moved into and out of the opening 166 when desired.

The rectangularly shaped elongated member 164 also provides an additional support which, cooperates with the pair of elongated leg members 124, to properly maintain the apparatus 120 in the desired upright position.

The apparatus 120 is also provided with a second elongated support member, generally designated, by the numeral, 180 which is coupled to the horizontally extending support member 138 of the support bracket 132 adjacent one end of the shield 145. The second elongated support member 180 includes an internal elongated opening 182 formed therethrough. The second elongated support member 180 is also provided with an opening 184 which is formed on an outermost surface thereof to extend into the internal opening 182. An engaging member or screw 186 is mounted for movement in the opening 184.

When it is desired to clean the roller 12, the roller is supported in the apparatus by inserting a handle 88 of the roller in the opening 166 in the rectangularly shaped elongated support member 164. The engaging screw 176 is then moved into the opening 164 to engage the handle 88 so that the handle is held in a stationary position. This positions the roller 12 between the shields 145 and 154 in an upwardly ascending diagonal position so that the shields 145 and 154, respectively are on each side the roller. As in the first and second embodiments in this position once a spray of water from, for example, a water hose, is directed against the exposed portion of the roller the roller will spin thereby allowing the paint to be washed out of the roller. While this is going on because of the position of the roller 12 between the shields the user is shielded from the paint and water spray that would normally spread over the user and other areas in proximity of the user.

Similarly when it is desired to clean the brush 14 a handle 90 of the brush is supported in the apparatus 10 by inserting the handle 90 in the opening 182 of the second elongated support member 180 so that the brush is supported upright in the opening. The engaging member 186 is then inserted through the opening 182 of the elongated support member 180 and into engagement with the handle 90. This holds the brush 14 in place in the elongated support member 180. In this instance a spray of water can be directed first at one side of the brush 14 and then at the other side until the brush is thoroughly clean.

Additionally, when it is desired to clean the roller pan 16 (FIG. 1) can supported on the vertically extending planar support member 146 of the shield 145 by a pair of legs 92 forming a part of the pan. Each one of the legs 92 can be aligned on an adjacent part of the horizontally extending planar shaped member 146 so that the pan 16 is supported in a diagonally descending position so that once a spray of water is applied thereto a thorough cleaning of the pan can be achieved.

Once the cleaning process is completed the paint roller 12, paint brush 14 and roller pan 16 (FIG. 1) can be left in the designated position thereby allowing them to dry and be stored for future use.

It should be further understood that various changes and modifications can be made without departing from the spirit of the invention as defined in the claim.

What is claimed:

1. A painting implement cleaning and supporting apparatus including:

a base support member;

a rectangularly shaped support member coupled to upper portions of the base support member;

a first means aligned with and coupled to first portions of the rectangularly shaped support member for supporting a roller thereon;

a first shield aligned with and coupled to second portions of the rectangularly shaped support member;

a second shield spaced from the first shield aligned with and coupled to third portions of the rectangularly shaped support member so that a paint spread from the roller can be contained in a predetermined confined area;

a second means aligned with and coupled to third portions of the base support member for supporting a brush thereon in a predetermined diagonal position;

a means included in the rectangularly shaped support member for supporting a roller pan thereon in a predetermined diagonally descending position; and means for selectively supplying water to the roller, brush and roller pan to facilitate the cleaning thereof.

2. A painting implement cleaning and supporting apparatus as defined in claim 1 wherein the base support member includes:

a rectangularly shaped member having an aperture formed therein; and a longitudinally shaped extending member vertically mounted in the aperture in the rectangularly shaped member.

3. A painting implement cleaning and support apparatus as defined in claim 2 wherein the longitudinally shaped extending member includes:

a first elongated member having one end thereof mounted in the aperture in the base support member; and a second elongated member threadedly coupled at one end thereof to the other end of the first elongated member and coupled at the other end thereof to the rectangularly shaped support member.

4. A painting implement cleaning and support apparatus as defined in claim 3 wherein the rectangularly shaped support member includes:

a pair of spaced vertically extending members; and a pair of horizontally extending members spaced from each other with one of the pair aligned between and coupled to outermost upper portions of the pair of vertically extending members and with the other one of the pair aligned between and coupled to outermost lower outermost portions of the pair of vertically extending members so that an opening is formed between the vertical and horizontally extending members.

5. A painting implement cleaning and supporting apparatus as defined in claim 4 wherein the rectangularly shaped support member further includes a rectangularly shaped planar cover member having an opening formed therein coupled to the vertically extending members and the horizontally extending members to cover the opening formed therebetween.

6. A painting implement cleaning and supporting apparatus as defined in claim 5 wherein the first shield further includes:

a horizontally extending planar shaped member, having a pair of spaced openings formed in an outermost portion thereof, and coupled at an innermost portion thereof to the upper one of the horizontally extending members.

7. A painting implement cleaning and support apparatus as defined in claim 6 wherein the second shield includes a horizontally extending planar shaped member coupled at an innermost portion thereof to the lower one of the horizontally extending members.

8. A painting implement cleaning and supporting apparatus as defined in claim 7 wherein the first means includes a rectangularly shaped elongated support member having an internal opening extending the length thereof which is aligned adjacent to the opening in the planar shaped cover member, and an outer opening formed on an outer surface thereof which extends into the internal opening.

9. A painting implement cleaning and supporting apparatus as defined in claim 8 wherein the rectangularly shaped elongated support member further includes a rectangularly shaped support member coupled in a diagonally descending direction on the back of the planar shaped cover member.

10. A painting implement cleaning and supporting apparatus as defined in claim 9 wherein the rectangularly shaped elongated support member further includes:

a support block having an aperture formed therein; and an engaging screw threadedly supported in the support block for movement therein so that the engaging screw is aligned in the outer opening to be selectively moved into the internal opening in the elongated support member to couplingly engage portions of the roller and hold the roller in a predetermined position when desired.

11. A painting implement cleaning and supporting apparatus as defined in claim 10 wherein the second means includes an elongated support member having an internal opening formed therein and an outer opening formed on an outermost surface thereof to extend into the internal opening and an engaging member coupled for movement in the outer opening into the internal opening to engage portions of the brush so that the brush is held in a predetermined position.

12. A painting implement cleaning and supporting apparatus as defined in claim 11 wherein the elongated support member of the second means is coupled to the upper one of the pair of horizontally extending members.

13. A painting implement cleaning and support apparatus as defined in claim 1 wherein the base support member includes:

a longitudinally shaped extending member having one end thereof coupled to the rectangularly shaped support member;

a horizontally extending elongated member coupled to the other end of the longitudinally shaped extending member;

a first vertically extending member having a pointed end at lowermost portions thereof and coupled at uppermost portions thereof to first outermost portions of the horizontally extending elongated member; and a second vertically extending member, having a pointed end at lowermost portions thereof and coupled to second outermost portions of the horizontally elongated member.

14. A painting implement cleaning and support apparatus as defined in claim 1 wherein the base support member includes:

a first vertically extending elongated member having one end thereof coupled to an outermost end of one side of the rectangularly shaped support member; and a second vertically extending elongated member coupled to another outermost end of the one side of the rectangularly shaped support member.

15. A painting implement cleaning and support apparatus as defined in claim 14 wherein the rectangularly shaped support member includes:

a pair of spaced laterally extending members; and a pair of horizontally extending members spaced from each other with one of the pair aligned between and coupled to outermost portions of the pair of vertically extending members and with the other one of the pair aligned between and coupled to other outermost portions of the pair of vertically extending members so that an opening is formed between the laterally and horizontally extending members.

16. A painting implement cleaning and supporting apparatus as defined in claim 15 wherein the rectangularly shaped support member further includes a rectangularly shaped planar cover member, having an opening formed therein, coupled to the laterally extending members and the longitudinally extending members to cover the opening formed therebetween.

17. A painting implement cleaning and supporting apparatus as defined in claim 16 wherein the first shield further includes a vertically extending planar shaped member, coupled at innermost portions thereof to extend upwardly from intermediate portions of one of the horizontally extending members.

18. A painting implement cleaning and support apparatus as defined in claim 17 wherein the second shield includes a vertically extending planar shaped member coupled at innermost portions thereof to extend upwardly from intermediate portions of the other one of the horizontally extending members.

19. A painting implement cleaning and supporting apparatus as defined in claim 18 wherein the first means includes a rectangularly shaped elongated support member having an internal opening extending the length thereof which is aligned adjacent to the opening in the planar shaped cover member, and an outer opening formed on an outer surface thereof which extends into the internal opening.

20. A painting implement cleaning and supporting apparatus as defined in claim 19 wherein the rectangularly shaped elongated support member further includes a rectangularly shaped support member coupled in an upwardly extending diagonally descending direction on the back of the planar shaped cover member so that an additional support member is provided which cooperates with the first and second vertically extending elongated members to maintain the apparatus in an upright position.

21. A painting implement cleaning and supporting apparatus as defined in claim 20 wherein the rectangularly shaped elongated support member further includes:

a support block having an aperture formed therein; and an engaging screw threadedly supported in the support block for movement therein so that the engaging screw is aligned in the outer opening to be selectively moved into the internal opening in the elongated support member to couplingly engage portions of the roller and hold the roller in a predetermined position when desired.

22. A painting implement cleaning and supporting apparatus as defined in claim 21 wherein the second means includes an elongated support member having an internal opening formed therein and an outer opening formed on an outermost surface thereof to extend into the internal opening and an engaging member coupled for movement in the outer opening into the internal opening to engage portions of the brush so that the brush is held in a predetermined position.

23. A painting implement cleaning and supporting apparatus as defined in claim 22 wherein the elongated support member of the second means is coupled to one of the pair of horizontally extending members.

* * * * *